US007211720B1

(12) United States Patent
Dorfman et al.

(10) Patent No.: US 7,211,720 B1
(45) Date of Patent: May 1, 2007

(54) ADJUSTABLE BASS DRUM BEATER

(75) Inventors: Michael Dorfman, Prairie View, IL (US); George Szwaya, East Troy, WI (US); Robert E. Szwaya, Milwaukee, WI (US)

(73) Assignee: Trick Percussion Products, Inc., Schaumburg, IL (US)

( * ) Notice: Subject to any disclaimer, the term of this patent is extended or adjusted under 35 U.S.C. 154(b) by 0 days.

(21) Appl. No.: 11/254,977

(22) Filed: Oct. 20, 2005

(51) Int. Cl.
*G10D 3/16* (2006.01)

(52) U.S. Cl. ..... 84/322.1

(58) Field of Classification Search ..... 84/422.1, 84/422.2, 422.3, 422.4
See application file for complete search history.

(56) References Cited

U.S. PATENT DOCUMENTS 2,473,865 A * 6/1949 Dane ..... 84/404
2,799,199 A * 7/1957 Dane ..... 84/422.1
4,040,323 A * 8/1977 Kline ..... 84/422.4
4,567,808 A * 2/1986 Smith ..... 84/422.1
5,509,342 A * 4/1996 Augsburger ..... 84/422.1
5,526,728 A 6/1996 Behrenfeld
5,817,962 A * 10/1998 Behrenfeld ..... 84/422.1

FOREIGN PATENT DOCUMENTS

JP 408314449 A * 11/1996 ..... 84/422.4

* cited by examiner

*Primary Examiner*—Kimberly Lockett
(74) *Attorney, Agent, or Firm*—Beem Patent Law Firm

(57) ABSTRACT

A bass drum beater may include a shaft having a length, a beater head fixable to a selected position along the length, and a connector engageable to the beater head and to the shaft to secure the position. The beater head may form an angle with respect to the shaft and the angle may be adjustable along a range, which may be about 20 degrees to either side of perpendicular. A bass drum beater may also include a shaft, a beater head having a drumward side and a hole to engage the shaft, a beater face attachable to the drumward side, and a means for holding the beater head in a longitudinal position and an angular position with respect to the shaft, wherein the longitudinal position and the angular position are adjustable. The means may include a bushing around the hole and a screw engaging the bushing.

11 Claims, 2 Drawing Sheets

1/2
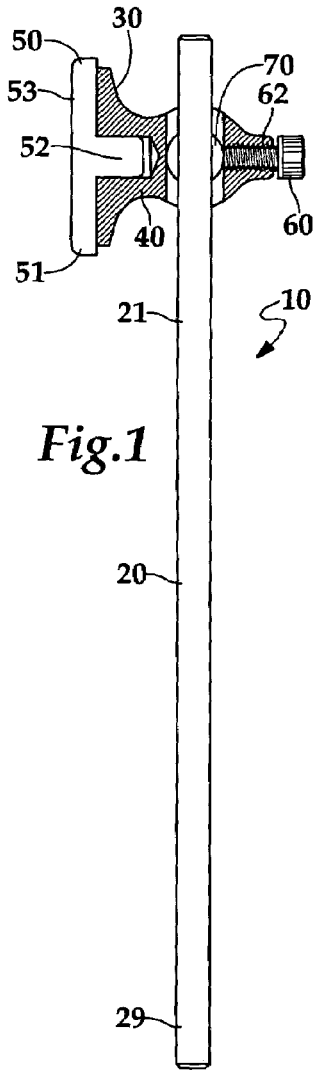
Fig.1
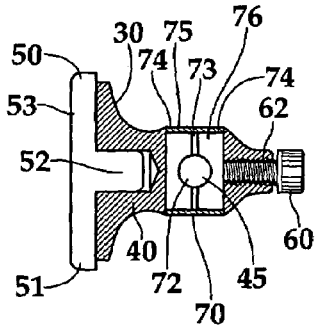
Fig.2
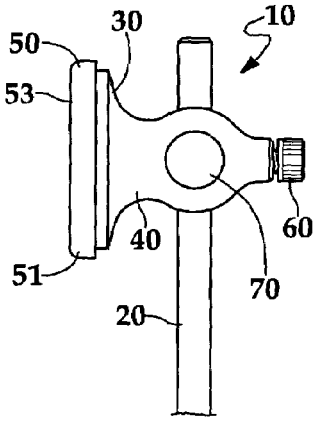
Fig.3
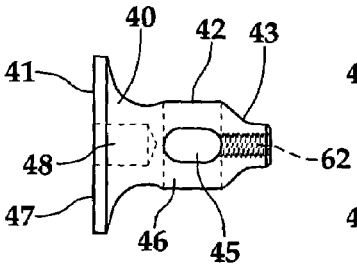
Fig.4
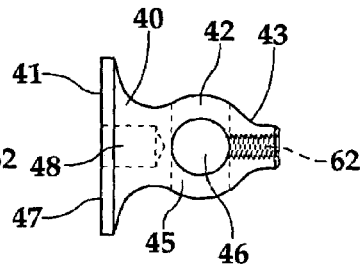
Fig.5
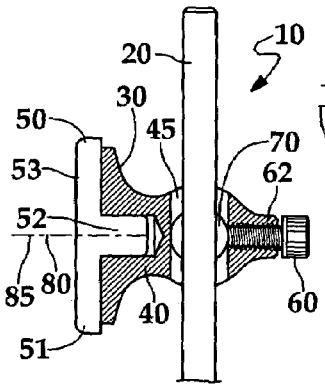
Fig.6
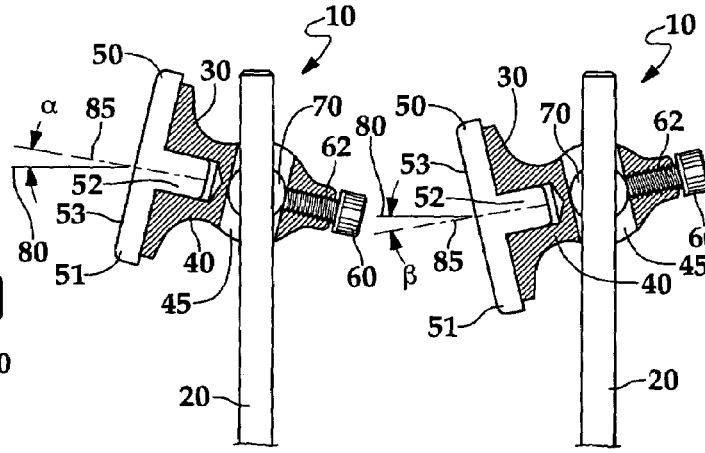
Fig.7
Fig.8

ADJUSTABLE BASS DRUM BEATER

BACKGROUND

1. Field of the Invention

This invention is directed to bass drum beaters, specifically a bass drum beater that adjusts to give drum players more options in equipment setup.

2. Brief Description of the Prior Art

A bass drum beater is operated by a drum pedal in conjunction with a player's foot to contact the surface of a bass drum. A bass drum is set up with a drum surface facing the front of a drum pedal. A bass drum beater usually comprises a shaft with a beater head at one end. The shaft is held by the drum pedal and the beater head swings in an arc when the drum pedal is depressed and contacts the drum surface.

Bass drums may come in different sizes and the floor upon which the drum is placed may not be even with the floor upon which the pedal is placed. In these circumstances, it may be beneficial to have a means for adjusting the bass drum beater so that the beater head hits the drum surface to produce the desired sound and tone. The bass drum beater may be placed so that the distance between the drum pedal and the beater head is longer or shorter, depending upon the desired contact position with respect to the bass drum. However, shortening the length of the distance from the drum pedal to the beater head usually involves shifting the position of bass drum beater as it is held by the drum beater and may result in the bottom of the shaft hitting the drum pedal or the drum head.

SUMMARY

The present invention provides a bass drum beater which may include a shaft having a length, a beater head fixable to a selected position along the length, and a connector engageable to the beater head and to the shaft to secure the position. The length of the shaft may be between about 6 inches and about 10 inches. The beater head may form an angle with respect to the shaft and the angle may be adjustable along a range, which may be about 20 degrees to either side of perpendicular. The shaft may be made from titanium and the beater head may be made from aluminum.

In another aspect of the invention, a bass drum beater may also include a shaft, a beater head having a drumward side and a hole to engage the shaft, a beater face attachable to the drumward side, and a means for holding the beater head in a longitudinal position and an angular position with respect to the shaft, wherein the longitudinal position and the angular position are adjustable. The means may include a bushing around the hole and a screw engaging the bushing. The bushing may have arms which are in contact with the shaft, and the screw may force one of the arms against the shaft.

BRIEF DESCRIPTION OF THE DRAWINGS

FIG. 1 is an elevation view of a cross section of a bass drum beater.

FIG. 2 is top view of a cross section of a beater head.

FIG. 3 is a side view of a beater head engaged to a top portion of a shaft.

FIG. 4 is a top view of a cross section of a beater body.

FIG. 5 is an elevation view of a cross section of a beater body.

FIG. 6 is an elevation view of a cross section of a bass drum beater engaged to a top portion of a shaft.

FIG. 7 is an elevation view of a cross section of a bass drum beater with a beater head angularly rotated upward and engaged to a top portion of a shaft.

FIG. 8 is an elevation view of a cross section of a bass drum beater with a beater head angularly rotated downward and engaged to a top portion of a shaft.

DETAILED DESCRIPTION OF THE INVENTION

Figure 9:
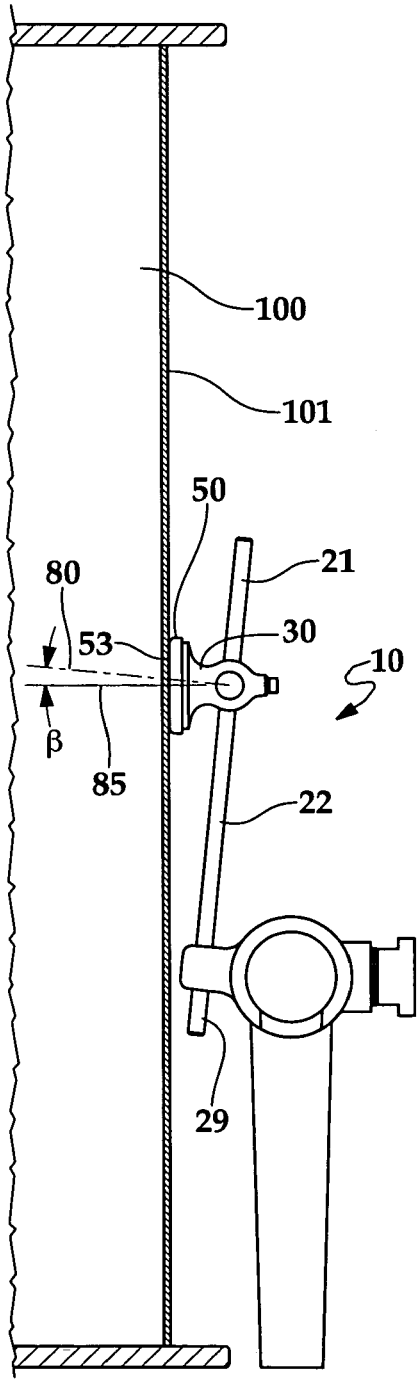
FIG. 9 is an elevation view of a cross section of a bass drum beater held in a drum pedal mechanism striking the surface of a small bass drum.

As shown in FIG. 1, bass drum beater 10 may include shaft 20 having a length, beater head 30 fixable to a selected position on shaft 20, and a connector engageable to beater head 30 and to shaft 20 to secure the position. As shown in FIG. 1, bass drum beater 10 may include shaft 20 and beater head 30.

Beater head 30 may be selectively positioned along the entire length of shaft 20 to strike a bass drum. Preferably beater head may be positioned along top portion 21 of shaft 20. Loosening screw 60 within screw hole 62 loosens bushing 70 and allows beater head 30 to slide along shaft 20. Preferably beater head 30 may be positioned on top portion 21 of shaft 20. Tightening screw 60 in screw hole 62 may cause screw to contact a connector in beater head 30 and locks beater head 30 to a position along the length of shaft 20. In one embodiment, the connector may be bushing 70.

Figure 10:
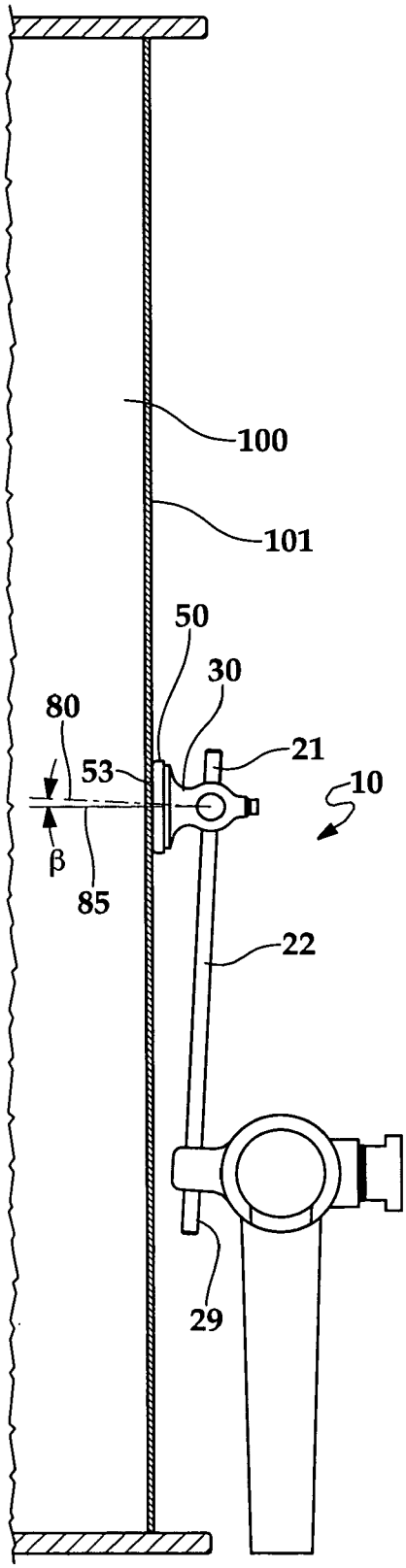
FIG. 10 is an elevation view of a cross section of a bass drum beater held in a drum pedal mechanism striking the surface of a large bass drum.

As shown in FIGS. 1, 9 and 10, shaft 20 may have top portion 21 and bottom portion 29. Bottom portion 29 may be held in a drum pedal and beater head 30 normally may be positioned along top portion 21. Shaft 20 may be between about 6 inches and about 10 inches, preferably between about 7 inches and about 9 inches, and in one embodiment may be about 8 inches. Construction of shaft 20 may include titanium. The diameter of shaft 20 may be between about 0.1 inches and about 0.4 inches, preferably between about 0.2 inches and about 0.3 inches, and in one embodiment about 0.25 inches.

As shown in FIGS. 2–5, beater head 30 may include beater body 40 which may be of unitary construction. In one embodiment (not shown), beater body 40 may be integral with beater face 50. As shown in FIG. 3, beater head 30 may engage shaft 20 through bushing 70 which may act as a connector engageable to both beater head 30 and to shaft 20. As shown in FIGS. 3 and 5, from the side, beater body 40 may be bugle-shaped with face portion 41 flaring out from midportion 42, and a pointed back portion 43.

As shown in FIGS. 4 and 5, beater head 30 has four holes, stem hole 48, shaft hole 45, screw hole 62, and bushing hole 46. Stem hole 48 extends inwardly from face surface 41 on face portion 41 between about 0.2 inches and about 0.6 inches, and in one embodiment about 0.45 inches. Stem hole 48 may be between about 0.3 inches and about 0.6 inches in width, and in one embodiment about 0.4 inches in width. Shaft hole 45 extends downwardly through the middle of midportion 42. Shaft hole 45 may be oval shaped and may be between about 0.2 inches and about 0.6 inches in length, preferably between about 0.3 inches and about 0.5 inches in length, and in one embodiment about 0.4 inches in length. Shaft hole 45 may be between about 0.2 inches and about 0.4 inches in width, and in one embodiment about 0.3 inches in width. Bushing hole 46 may be circular with a diameter of between about 0.2 inches and about 0.6 inches, and in one embodiment about 0.4 inches. Screw hole 62 may extend inwardly from back portion 43 of beater body 40. Screw hole may have a length of between about 0.2 inches and about 0.6 inches, and in one embodiment about 0.4 inches. Screw hole 62 may have a diameter of between about 0.2 inches and about 0.4 inches, and in one embodiment about 0.3 inches.

As shown in FIGS. 2, 3 and 5, bushing 70 fits within bushing hole 46 of beater head 30 and has bushing shaft hole 72 to hold shaft 20 extending through shaft hole 45. Bushing 70 has slot 73 and arms 74. In one embodiment, bushing 70 has two arms 74, drum arm 75 and screw arm 76. Slot 73 allows arms 74 to be flexible around bushing shaft hole 72 to hold shaft 20. When screw 60 is tightened in screw hole 62, the tip of screw 60 may force screw arm 76 to pinch shaft 20. The pinching action of screw arm 76 holds beater head 30 in a desired position on shaft 20.

The outer diameter of bushing 70 may be slightly smaller than the diameter of bushing hole 46 such that bushing 70 may fit in bushing hole 46 and rotate freely therein. Shaft 20 may fit through shaft hole 45 of beater head 40 and also fit through bushing shaft hole 72 of bushing 70 when bushing 70 is in place within bushing hole 46. The length of bushing 70 corresponds to the side thickness of midportion 42 and may be between about 0.5 inches and about 0.8 inches, preferably between about 0.6 inches and about 0.72 inches, and in one embodiment about 0.68 inches.

As shown in FIGS. 2, 4 and 5, in one embodiment, beater face 50 may be a separate piece from the rest of beater body 40. Beater face 50 may have strike flange 51 and stem 52. Strike flange 51 may include strike surface 53 which strikes the surface of a drum and beater surface 54, which engages face surface 47 on face portion 41. Face surface 47 may be toward the drumward side of beater head 30. Beater face 50 must be located on the drumward side of beater head 30 in order to contact a bass drum. As shown in FIGS. 2, 4 and 5, stem 52 fits within stem hole 48 extending through face portion 41 and part of midportion 42. In one embodiment, stem 52 may have double lead threads to thread into stem hole 48. Beater face 50 may be made of plastic and may have a thickness between about 0.1 inches and about 0.3 inches, preferably between about 0.15 inches and about 0.25 inches, and in one embodiment about 0.188 inches.

As shown in FIGS. 7–9, beater head 30 may be angularly adjustable with respect to shaft 20. Beater head 30 may typically be perpendicular to shaft 20, as shown in FIG. 6, and forming perpendicular line 80 with respect to shaft 20. Beater head 30 may have midline 85 and when it is perpendicular to shaft 20, perpendicular line 80 and midline 85 may be juxtaposed. However, if beater head 30 is angularly swiveled about bushing 70 so that beater head is not perpendicular with shaft 20, then perpendicular line 80 will make an angle with midline 85. As shown in FIG. 7, beater head 30 may be tilted towards top portion 21 and midline 85 may form angle $\alpha$ with perpendicular line 80. Angle $\alpha$ may be between about 0 degrees and about 20 degrees, and in one embodiment about 14 degrees. As shown in FIG. 8, beater head 30 may be tilted towards bottom portion 29 and midline 85 may form angle $\beta$ with perpendicular line 80. Angle $\beta$ may be between about 0 degrees and about 20 degrees, and in one embodiment about 14 degrees.

As shown in FIG. 6, when shaft 20 is positioned within shaft hole 45 and bushing shaft hole 72, bushing 70 may rotate within bushing hole 46 to the range allowable by the length of shaft hole 45. A longer length of shaft hole 45 would increase the range of both angle $\alpha$ and angle $\beta$. In one embodiment, a length of about 0.438 inches corresponds to a range of 14 degrees for angle $\alpha$ and a range of about 14 degrees for angle $\beta$.

As shown in FIGS. 9 and 10, bass drums 100 may be different sizes. As a result, length 22 between beater head 30 and the drum pedal and angle $\beta$ may need to be adjusted so strike face 53 of beater face 50 strikes drum surface 101 at the desired location for the desired sound. Positioning beater head 30 lower on upper portion 21 shortens length 22 and positioning beater head 30 higher on upper portion 21 lengthens length 22. An advantage of adjustable bass drum beater 10 may be that lower portion 29 may be held in the same position by a drum pedal. Thus, lower portion 29 may never contact the drum pedal when bass drum beater 10 swings toward drum surface 101 regardless of the position of beater head 30 on shaft 20.

Screw 60 contacts bushing 70, specifically as screw 60 is screwed into screw hole 62 the tip of screw 60 pushes against screw arm 76 and forces screw arm 76 tightly against shaft 20. Screw 60 forces bushing 70 to pinch shaft 20 to hold beater head 30 in place both longitudinally and angularly with respect to shaft 20. Tightening screw 60 may hold both the desired longitudinal position and the desired angular position of beater head 30 on shaft 20. This allows very easy and fast adjustment of bass drum beater 10 because only one screw needs to be manipulated for all desired adjustments.

Since many possible embodiments may be made of the invention without departing from the scope thereof, it is understood that all matter herein set forth or shown in the accompanying drawings is to be interpreted as illustrative, and not in a limiting sense.

We claim:

1. A bass drum beater, comprising:

a shaft having a length;

a beater head adjustable and fixable to a selected position along said length;

wherein said beater head forms an angle adjustable along a range with respect to said shaft and said beater head is fixable at a selected angle within said range; and a connector engageable to said beater head and to said shaft to secure said beater head in said position and at said angle.

2. A bass drum beater according to claim 1, wherein said length is between about 6 inches and about 10 inches.

3. A bass drum beater according to claim 1, wherein said beater has an axis that forms a perpendicular line with said length and wherein said range is about 20 degrees to either side of said perpendicular line.

4. A bass drum beater according to claim 2, wherein said shaft is comprised of titanium and said beater head is comprised of aluminum.

5. A bass drum beater, comprising:

a shaft;

a beater head having a drumward side, a hole to engage said shaft;

a beater face attachable to said drumward side; and a means for holding said beater head in a longitudinal position and in an angular position with respect to said shaft, wherein said longitudinal position and said angular position are adjustable.

6. A bass drum beater according to claim 5, wherein said hole has an oval cross-section.

7. A bass drum beater according to claim 5, wherein said means comprises a bushing around said hole and a screw engaging said bushing.

8. A bass drum beater according to claim 7, wherein said bushing has arms in contact with said shaft, and wherein said screw forces at least one of said arms against said shaft.

9. A bass drum beater, comprising:

a shaft;

a beater head having a drumward side, a shaft hole to engage said shaft, and a bushing hole for a bushing;

a beater face attachable to said drumward side;

a bushing for holding said beater head in a selected longitudinal position and in a selected angular position within respect to said shaft, wherein said longitudinal position and said angular position are adjustable; and a screw engaging said bushing.

10. A bass drum beater according to claim 9, wherein said bushing has arms in contact with said shaft, and wherein said screw forces at least one of said arms against said shaft.

11. A bass drum beater according to claim 9, wherein said shaft hole has an oval cross-section.

* * * * *

UNITED STATES PATENT AND TRADEMARK OFFICE

CERTIFICATE OF CORRECTION

PATENT NO. : 7,211,720 B1
APPLICATION NO. : 11/254977
DATED : May 1, 2007
INVENTOR(S) : Michael Dorfman, George Szwaya and Robert E. Szwaya It is certified that error appears in the above-identified patent and that said Letters Patent is hereby corrected as shown below:

Column 6, line 3, the word "within" should be changed to --with--.

Signed and Sealed this

Nineteenth Day of June, 2007

JON W. DUDAS
*Director of the United States Patent and Trademark Office*